United States Patent [19]

McNair et al.

[11] 4,326,236

[45] Apr. 20, 1982

[54] CONTROL SYSTEM FOR AN ELECTRO-MAGNETIC BRAKE

[75] Inventors: Willie L. McNair; Donald L. Lipke, both of Fort Bend County; Stanley H. Van Wambeck, Harris County; Conrad J. Huelsman, Fort Bend County, all of Tex.

[73] Assignee: Baylor Company, Sugar Land, Tex.

[21] Appl. No.: 74,205

[22] Filed: Sep. 10, 1979

[51] Int. Cl.[3] ..... F16D 67/06

[52] U.S. Cl. ..... 361/170; 336/136; 361/160; 303/20; 188/158

[58] Field of Search ..... 361/160, 170, 190; 303/20; 336/136; 188/159, 161, 162

[56] References Cited

U.S. PATENT DOCUMENTS

| | | | |
|---|---|---|---|
| 3,371,253 | 2/1968 | Hubbard | 188/158 X |
| 3,538,392 | 11/1970 | Carmichael et al. | 188/158 X |
| 3,546,648 | 12/1970 | Chass | 336/136 |
| 3,592,316 | 7/1971 | Daab et al. | 361/170 |
| 3,614,565 | 10/1971 | Mierendorf | 188/161 |
| 3,909,075 | 9/1975 | Pittet, Sr. et al. | 303/20 |
| 3,958,835 | 5/1976 | Rothfusz et al. | 303/20 X |
| 3,967,863 | 7/1976 | Tomecek et al. | 303/20 X |
| 3,994,348 | 11/1976 | Schowalter | 336/136 X |

*Primary Examiner*—J. D. Miller
*Assistant Examiner*—L. C. Schroeder
*Attorney, Agent, or Firm*—Fulbright & Jaworski

[57] ABSTRACT

A control system for providing controllable direct current power for energizing an electromagnetic brake having an alternating current power supply and a power rectifier for converting and supplying direct current power to the brake. A power switch controls the amount of direct current power supplied to the brake. A control circuit controls the actuation of the power switch and includes a brake control actuating a variable output transformer. The output from the transformer is converted to a variable pulse width signal for actuating the power switch. Preferably, the transformer is a variable ratio transformer having a movable core connected to the operator's control. A battery charger and batteries may be connected to the ouput of the power rectifier for maintaining brake power in the event of alternating current line failure. Multiple transistor power switches connected to separate brake coils maintain a portion of brake power in the event of partial equipment failure. An oscillator provides a sine wave voltage to the transformer primary and the actuation of the operator's control provides a substantially linear output from the transformer secondary. Protective circuits such as an RC filter may be connected across the power rectifier to limit overshoot upon actuation and a rectifier is connected across the brake for current flow during the time the power switch is off.

7 Claims, 5 Drawing Figures

CONTROL SYSTEM FOR AN ELECTRO-MAGNETIC BRAKE

BACKGROUND OF THE INVENTION

It is conventional to utilize eddy current type electromagnetic brakes, for example on draw works on oil field drilling equipment. The present invention is directed to a control system for providing controllable direct current power for energizing the electric coils of a brake. Specifically, the present invention is directed to a control system for varying the direct current power to energize electromagnetic brakes, and to a brake control for controlling the braking action.

SUMMARY

The present invention is directed to a control system for providing a controllable direct current power for energizing electromagnetic brakes including an alternating current supply connected to a power rectifier for converting and supplying direct current power to the brake. Power switch means controls the amount of the direct current power supplied to the brake. A control circuit provides a variable pulse width signal which is varied by an operator's control and controls the actuation of the power switch means for controlling the amount of direct current supply to the brake.

A still further object of the present invention is the provision of a control circuit for controlling the actuation of the power switch means which includes a variable ratio transformer having a movable core connected to the operator's control and in which the input of the transformer is connected to a sine wave oscillator whereby the output from the transformer varies in proportion to the actuation of the brake control. The variable pulse width signal may be provided by a rectifier connected to the transformer output, a sawtooth oscillator, and a comparator connected to the rectifier and saw tooth oscillator to provide the variable pulse width signal which varies with the transformer output.

Another object is to provide a control circuit in which a maximum pulse width control signal is provided in the event of a loss of the output from the transformer for providing full brake power.

Still a further object of the present invention is the provision of two transistor power switches connected to separate brake coils for maintaining a portion of the brake power in the event of a partial equipment failure.

Still a further object of the present invention is the provision of a battery charger and batteries connected to the output of the power rectifier means for providing a power backup in the event of the failure of the alternating current supply.

Yet a further object of the present invention is the provision of an operator's control which provides a substantially linear output in which the operator's control actuates a variable positioned ferrite core that couples the primary and secondary of the transformer.

A still further object of the present invention is the provision of protective circuits including an RC filter connected across the power rectifier to limit overshoot upon actuation, and a rectifier connected across the brake for providing current flow during the time the power switch is off.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
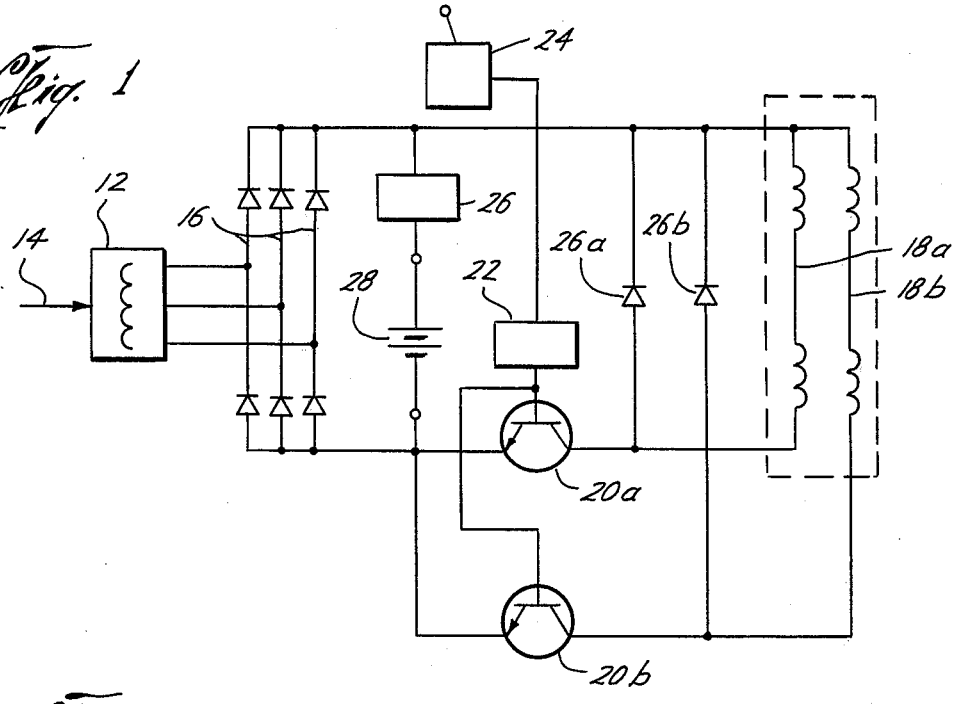
FIG. 1 is a simplified schematic diagram of the present invention.

Referring now to FIG. 1, the reference numeral 10 generally indicates the control system of the present invention and generally includes a transformer 12 connected to an alternating current power supply 14 for providing input alternating current power. A power rectifier 16 is connected to the input power for converting and supplying direct current power, such as three phase full rectified dc power, to one or more sets of brake coils 18*a* and 18*b*. One or more power switch means 20*a* and 20*b* are connected between the rectifier 16 and the brake coils 18*a* and 18*b* for controlling the direct current power or braking power supplied to the coils 18*a* and 18*b*. A control circuit 22 is provided for controlling the actuation of the power switches 20*a* and 20*b* and is in turn controlled by a brake control means 24.

The power switch means 20*a* and 20*b* are preferably power transistors which are driven on and off. Rectifiers, such as diodes 26*a* and 26*b*, are connected across the brake coils 18*a* and 18*b*, respectively, to provide an alternate path for coil current during the off intervals of the switches 20*a* and 20*b*, respectively. The percentage time that the transistors 20*a* and 20*b* are on is controlled by the brake control 24 through the control circuit 22 to provide a variable pulse width signal for actuating the transistors 20*a* and 20*b*.

Figure 2:
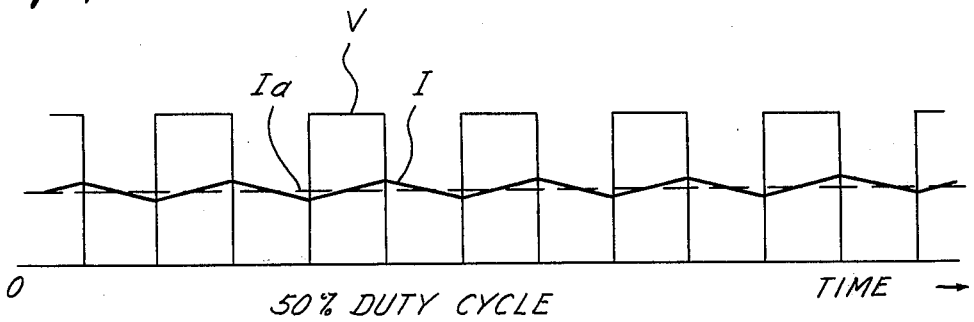
FIG. 2 is a graph showing the wave shape of the voltage and current through the brake for a 50% duty cycle.
Figure 3:
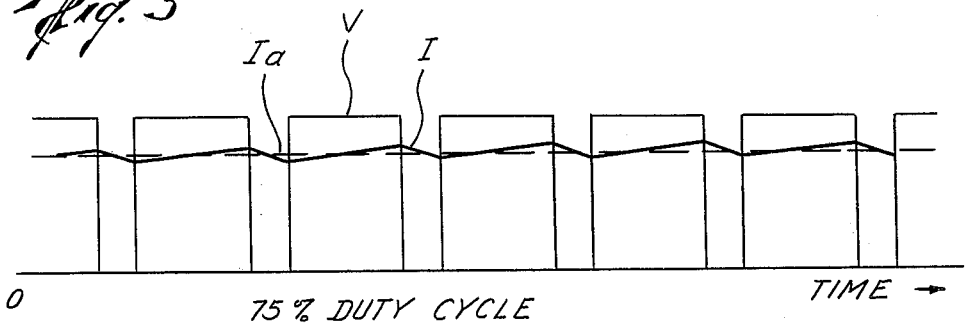
FIG. 3 is a graph showing the wave shape of the voltage and current through the brake for a 75% duty cycle.

Referring to FIGS. 2 and 3, two different sets of wave shapes for different output conditions are shown. The wave shapes for FIG. 2 is for a 50% duty cycle in which the transistor switch is on for half of each switching cycle. The wave shape in FIG. 3 represents a 75% duty cycle in which the transistor switch is on for 75% of the time of each switching cycle. When a transistor is on there is a full voltage V applied to one of the brake coils and the top of the square wave represents this voltage V, such as 250 volts from the rectifier 16. In FIGS. 2 and 3, the switching of the waves is represented as an ideal pure square wave while in actual practice the rise and fall of voltage may take some short time and there is generally some slight rounding of the square shoulders and may be a small amount of overshoot. Superimposed on the voltage form V is a typical graph of the coil current I shown in solid line and the average current I*a* shown in dotted line. In the case of 50% duty cycle of FIG. 2, the coil current is seen to rise slowly during the on interval and to drop an equal amount during the off interval. When the duty cycle is 75%, as shown in FIG. 3, the average current is higher and the rate of rise during the on interval is somewhat less. When the duty cycle is 50% the direct current will be half of maximum and when the duty cycle is 75% the dc current will be 75% of the maximum. Therefore, by applying a pulse width which varies with the actuation of the brake control 24 the direct current supplied to the brake coils may be varied to obtain the desired amount of braking.

In addition, a battery charger 26 and batteries 28 are connected across the rectifier 16 for providing power backup in the event of failure of the alternating current supply 14.

Figure 4A:
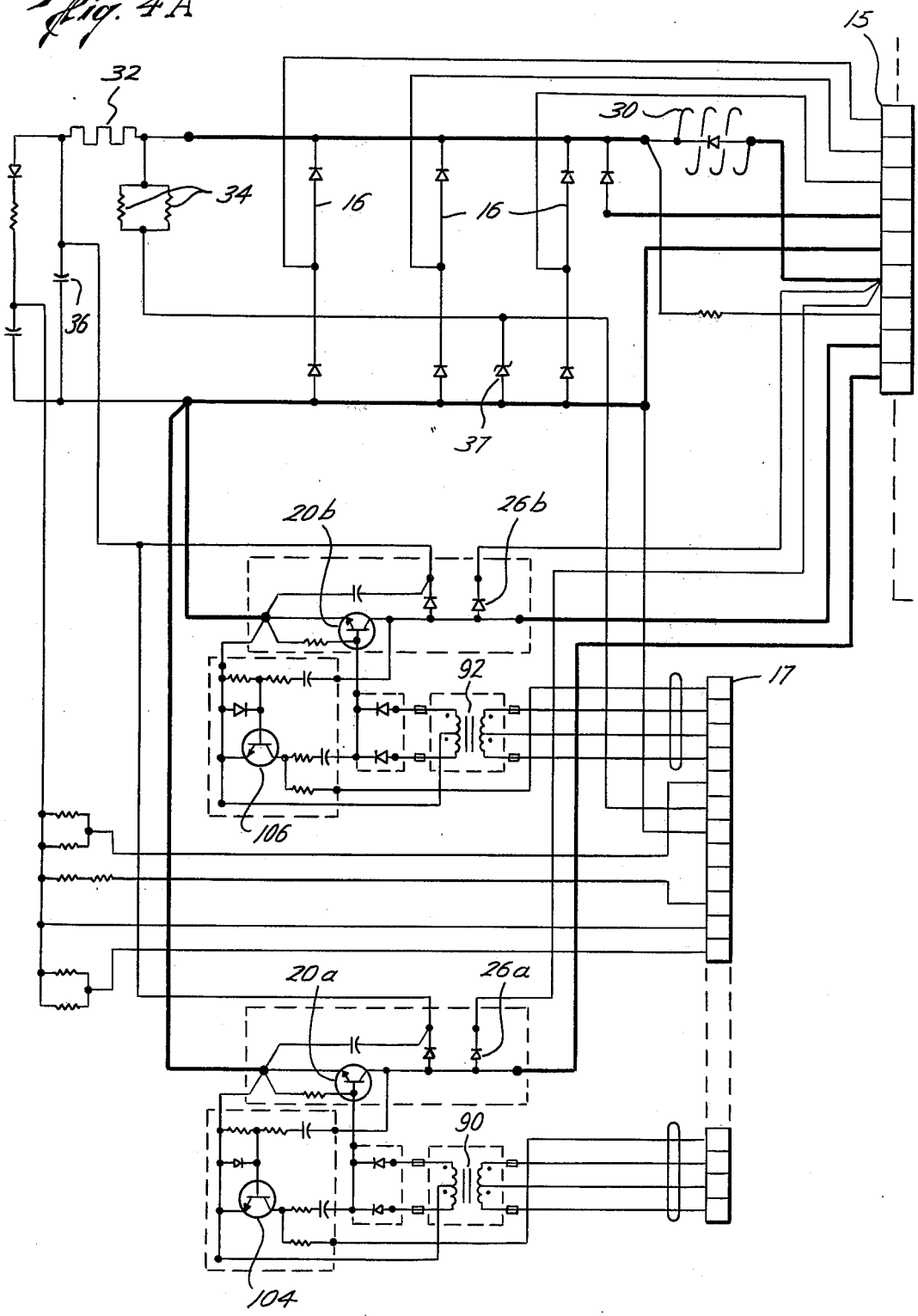
FIGS. 4A, 4B and 4C are continuations of each other of a more detailed schematic of the present invention.
Figure 4B:
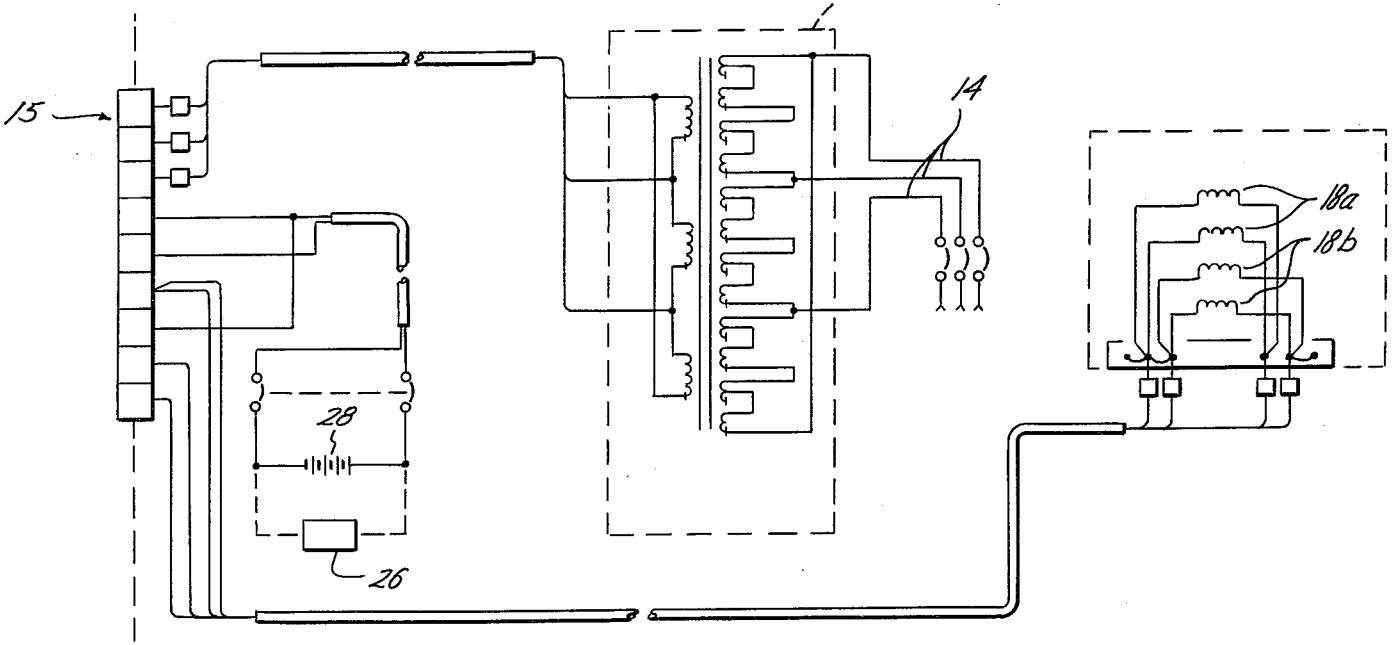

Referring now to FIGS. 4A and 4B, a more detailed schematic of FIG. 1 is shown wherein the alternating current supply 14 is provided through the transformer 12 through terminal board 15 to the full wave rectifier bridge 16 and flows through a choke 30 back through the brake coils 18*a* and 18*b* of any suitable electromagnetic brake such as model 7838 sold by the Baylor Company under the trademark "Elmagco" and returns through transistor power switches 20*a* and 20*b*. Overshoot of the rectified direct current at turn on is minimized through the damping and filtering of resistor 32 and capacitor 36.

While only a single power transistor switch 20*a* or 20*b* need be provided connected to all of the brake coils of the brake, it is sometimes preferable to provide at least two power transistors 20*a* and 20*b* to provide separate power paths to separate brake coils 18*a* and 18*b* to provide partial redundancy in the event of a failure in one of the power path components and to provide additional current.

The control power supply is obtained from the rectifier power bus through resistors 34 and zener diode 37 to provide the power source for other control circuits.

Figure 4C:
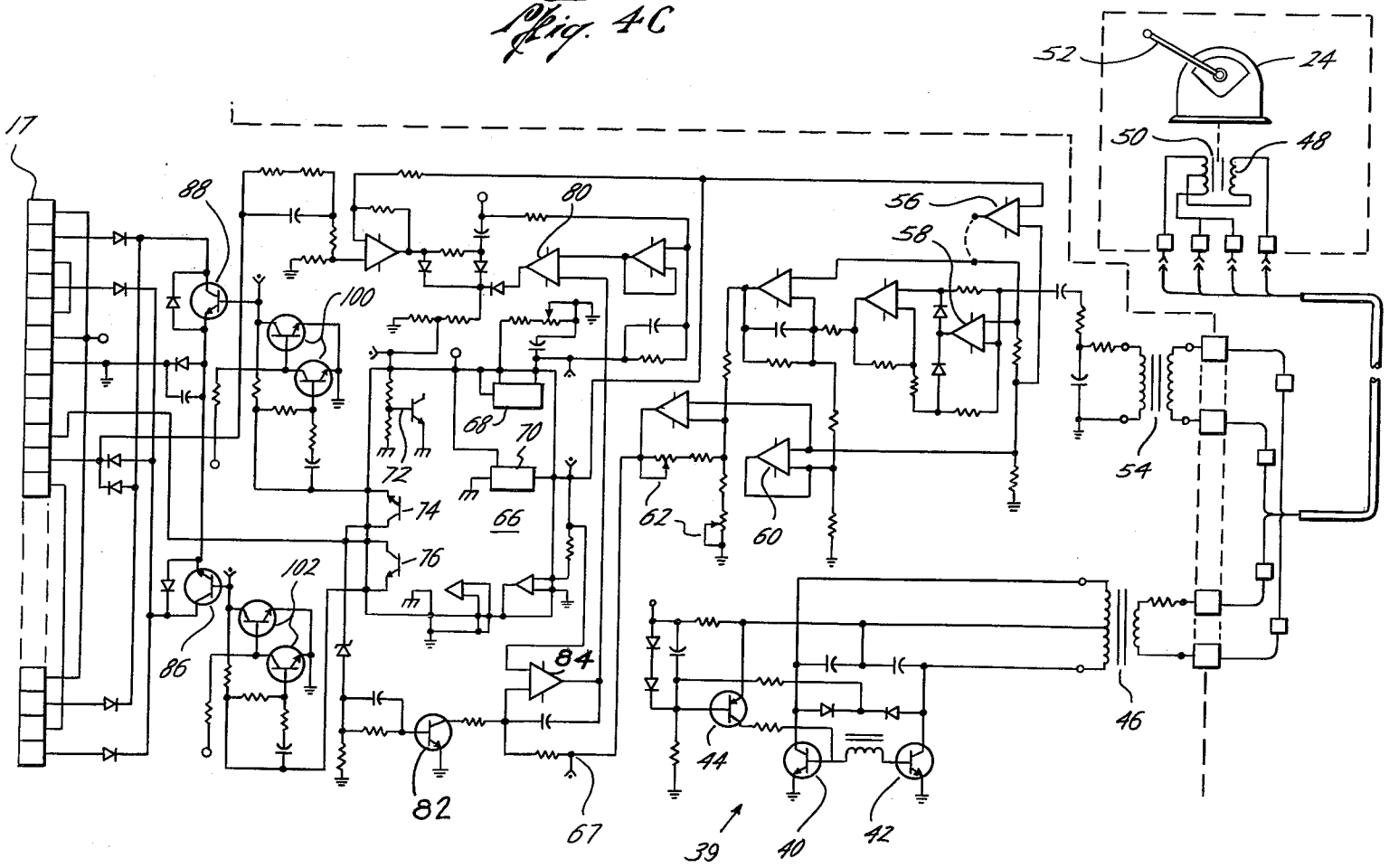

As has previously been mentioned, the application of direct current to the brake is controlled by a brake control 24 through a control circuit 22 to provide the variable pulse width signal for controlling the power switches 20*a* and 20*b*. Referring now to FIG. 4C, a more detailed schematic of the control circuit 22 is best seen. A fixed sine wave alternating current control voltage is provided by a free running oscillator 39 consisting of transistors 40 and 42 in which regenerative oscillation is started by the oscillator 39 and particularly a transistor 44 and maintained through the feedback from isolation transformer 46. The brake control 24 is the only operational control device required in the present system 10 and preferably includes, as will be more fully described hereinafter, a variable ratio transformer 48 having a movable ferrite core 50 which is adjusted by the handle 52 of the brake control 24 to provide a variable output signal from the transformer's secondary which varies with the actuation of the handle 52. That is, the isolation transformer 46 transmits the fixed sine wave alternating current generated by the oscillator 39 to the variable ratio transformer 48 and the variable alternating current signal output from the transformer 48 is supplied to a second isolating transformer 54 beyond which the signal is amplified, rectified, filtered with operational amplifiers 56, 58 and 60, thereby providing a direct current signal which varies with the actuation of the handle 52. Trim pots 62 allow the output signal at point 67 to be suitably trimmed.

The width of the duty cycle or pulse width is achieved by comparing the rectified output at point 64 with the buffered sawtooth output of an integrated circuit 66 which may be of the type SG1524 sold by Signetics, Inc., and generally includes a sawtooth oscillator 68, a voltage regulator 70, a shutdown circuit 72, and a pair of transistors 74 and 76 driven in push-pull. The sawtooth oscillator 68 generates a linear ramp at the basic switching frequency which is transmitted to one input of a comparator 80. The other input to the comparator 80 is determined by the output signal at point 67 which also includes a feedback signal through transistor 82 and a reference level from the regulator 70 through the integrator 84. The comparator 80 provides a variable pulse width signal after comparing the rectified output from the brake control 24 with the sawtooth output of the oscillator 68 which determines the width of the on interval each switching cycle. The output of comparator 80 is then fed to the shutdown circuit 72 to drive the transistors 74 and 76 in push-pull. Transistors 74 and 76 in turn control the power transferred to the bases of control transistors 86 and 88 which in turn through terminal board 17 provide the means of alternately energizing transformers 90 and 92 to provide drive power to power transistors 20*a* and 20*b*. Transistors 100, 102, 104 and 106 are turn off transistors to assist in turning off the transistors to which they are connected.

It is to be noted that the comparator 80 compares the output from the brake control 24 with the sawtooth oscillator in a manner to apply full brake power in the event that the output from the brake control 24 is lost. That is, the presence of a low signal level at point 64 is selected to create an on state.

Figure 5:
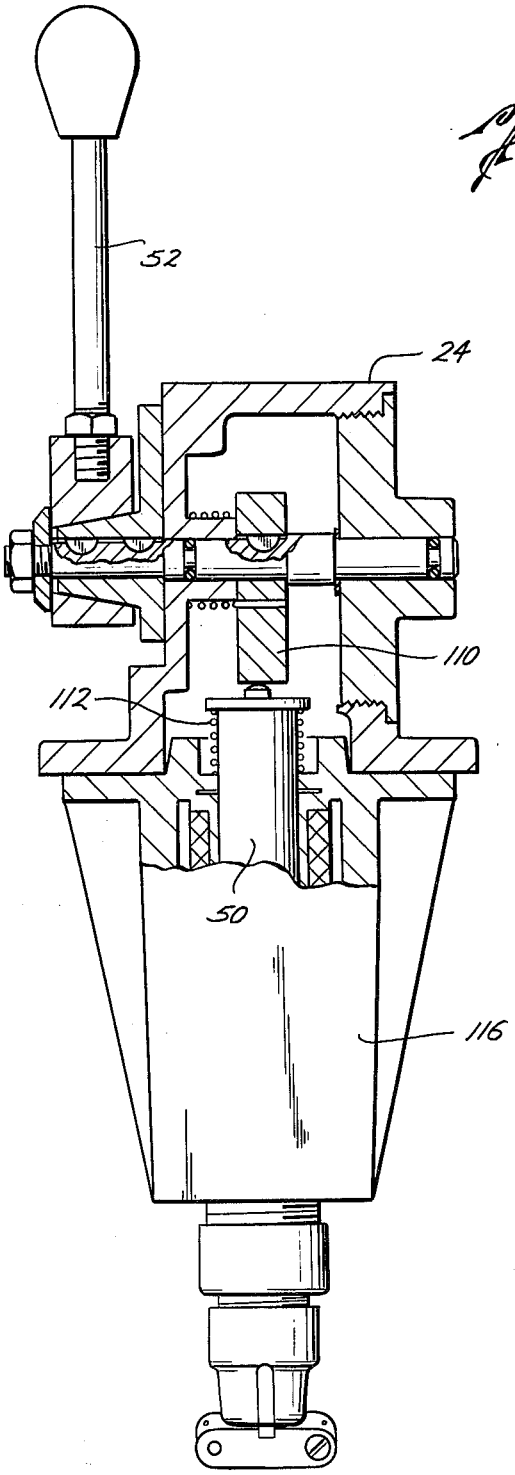
FIG. 5 is a cross-sectional view of the brake control of the present invention.

Referring now to FIG. 5, one embodiment of the brake control 24 is best seen which includes an actuating handle 52 which is coupled to an eccentric cam 110 to operate a spring 112 biased magnetic core 50 through an encapsulated coil assembly 116. The coil assembly consists of a primary and secondary winding with a fixed alternating current voltage from oscillator 39 connected to the primary. Actuation of the handle 52 varies the position of the core 50 through the center of the assembly 116 changing the effective magnetic coupling to produce a variable output from the secondary coil. Coil encapsulation prevents exposure to any surrounding explosive or hazardous gases. The cam 110 includes a periphery which will provide an output signal from the secondary coil which will vary substantially linearly from one voltage level to another.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A control system for providing controllable direct current power for energizing an electromagnetic brake comprising, an alternating current power supply, power rectifier means connected to the alternating current power supply for supplying direct current power to said brake, power switch means connected between the rectifier and the brake for controlling the direct current power supplied to the brake, a control circuit controlling the actuating of said power switch means including, a brake control connected to a variable output transformer, the input of said transformer being connected to a fixed control voltage supply and whose output is varied by said brake control, means connected between the transformer output and said power switch means for providing a variable pulse width direct current signal in which the pulse width varies with the transformer voltage output for actuating said power switch means, and wherein the means for providing a variable pulse width signal includes, a rectifier connected to the transformer, an oscillator providing a sawtooth output, and a comparator connected to the rectifier and sawtooth oscillator to provide the variable pulse width signal.

2. The apparatus of claim 1 including, an RC filter connected across the power rectifier to limit overshoot upon actuation.

3. The apparatus of claim 1 including, a rectifier connected across the brake for current flow during the time the power switch means is off.

4. The apparatus of claim 1 wherein said comparator provides a maximum pulse width signal in the event of loss of output from said transformer for providing full brake power.

5. A control system for providing controllable direct current power for energizing an electromagnetic brake comprising, an alternating current power supply, power rectifier means connected to the alternating current power supply for supplying direct current power to said brake, power switch means connected between the rectifier and the brake for controlling the direct current power supplied to the brake, wherein the power switch means includes two transistor power switches for connection to separate brake coils for providing a portion of brake power in the event of partial failure, a control circuit controlling the actuation of said power switch means including, a brake control connected to a variable output transformer, the input of said transformer being connected to a fixed control voltage supply and whose output is varied by said brake control, and means connected between the transformer output and said power switch means for providing a variable pulse width direct current signal in which the pulse width varies with the transformer voltage output for actuating said power switch means.

6. The apparatus of claim 5 wherein separate variable pulse width signals are provided to each power switch.

7. A control system for providing controllable direct current power for energizing an electromagnetic brake comprising, an alternating current power supply, power rectifier means connected to the alternating current power supply for supplying direct current power to said brake, power switch means connected between the rectifier and the brake for controlling the direct current power supplied to the brake, a control circuit controlling the actuation of said power switch means including, a manual brake control connected to a variable ratio transformer having a movable core actuated by the brake control, the input of said transformer being connected to a fixed alternating current control voltage supply, and the output is varied by said brake control, a rectifier connected to the transformer output and converting said output to direct current, an oscillator providing a sawtooth output, a comparator connected to the output of the rectifier and the oscillator to provide a signal having a pulse width proportional to the transformer output, said output of the comparator connected to and actuating said power switch means.

* * * * *

UNITED STATES PATENT OFFICE

CERTIFICATE OF CORRECTION

Patent No. 4,326,236 Dated April 20, 1982

Inventor(s) Willie L. McNair et al.

It is certified that error appears in the above-identified patent and that said Letters Patent are hereby corrected as shown below:

Column 3, line 66, delete "64" and insert -- 67 --

Column 4, line 29, delete "64" and insert -- 67 --

Signed and Sealed this

*Seventh* Day of *September 1982*

[SEAL]

*Attest:*

GERALD J. MOSSINGHOFF

*Attesting Officer* *Commissioner of Patents and Trademarks*